US011479913B2

(12) United States Patent
Soylu et al.

(10) Patent No.: US 11,479,913 B2
(45) Date of Patent: Oct. 25, 2022

(54) FIBER PRODUCTION WITH SUPERCRITICAL FLUID PHASE FROM COTTON STRAW

(71) Applicant: VERITAS TEKSTIL KONFEKSIYON PAZARLAMA SANAYI VE TICARET ANONIM SIRKETI, Denizli (TR)

(72) Inventors: Mustafa Soylu, Denizli (TR); Mehmet Kivanç Alay, Denizli (TR)

( * ) Notice: Subject to any disclaimer, the term of this patent is extended or adjusted under 35 U.S.C. 154(b) by 197 days.

(21) Appl. No.: 16/769,082

(22) PCT Filed: Feb. 13, 2019

(86) PCT No.: PCT/TR2019/050093

§ 371 (c)(1),
(2) Date: Jun. 2, 2020

(87) PCT Pub. No.: WO2020/096542

PCT Pub. Date: May 14, 2020

(65) Prior Publication Data

US 2021/0172117 A1 Jun. 10, 2021

(30) Foreign Application Priority Data

Nov. 5, 2018 (TR) ..... 2018/16585

(51) Int. Cl.

| | |
|---|---|
| ***D21H 13/08*** | (2006.01) |
| ***D21C 3/04*** | (2006.01) |
| ***D21H 11/12*** | (2006.01) |
| ***D21C 3/16*** | (2006.01) |
| ***D21C 3/18*** | (2006.01) |
| ***D21C 9/10*** | (2006.01) |

(52) U.S. Cl.
CPC ..... *D21C 3/04* (2013.01); *D21C 3/16* (2013.01); *D21C 3/18* (2013.01); *D21C 9/10* (2013.01); *D21H 11/12* (2013.01); *D21H 13/08* (2013.01)

(58) Field of Classification Search
CPC ... D21C 3/04; D21C 5/00; D21C 3/16; D21C 3/18; D21H 11/12; D21H 13/08; D01C 1/00
USPC ..... 162/72, 76, 81, 95
See application file for complete search history.

(56) References Cited

U.S. PATENT DOCUMENTS 3,875,141 A * 4/1975 Drisch ..... D01F 2/08 536/63
6,790,527 B1 9/2004 Luo et al.
(Continued)

FOREIGN PATENT DOCUMENTS

CN 101298701 A 11/2008
EP 3093389 A1 11/2016
(Continued)

OTHER PUBLICATIONS

International Search Report for corresponding PCT/TR2019/050093.
Written Opinion of the ISA for corresponding PCT/TR2019/050093.

*Primary Examiner* — Eric Hug
(74) *Attorney, Agent, or Firm* — Egbert, McDaniel & Swartz, PLLC

(57) ABSTRACT

Disclosed is a method of obtaining regenerated cellulose fiber by using supercritical-$N_2O$ and/or supercritical-$CHF_3$ compounds from cotton straw which are formed as thin chips mechanically.

6 Claims, 1 Drawing Sheet

(56) References Cited

U.S. PATENT DOCUMENTS

Figure 1:
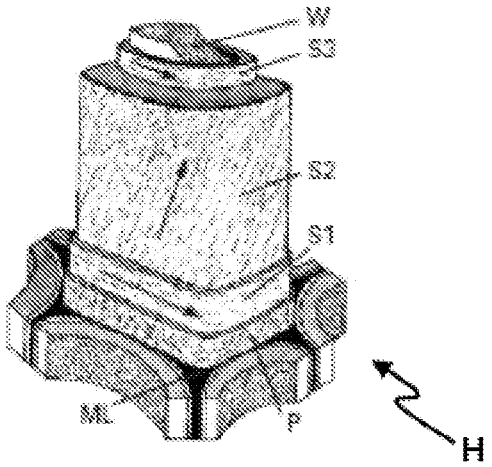

| | | | | |
|---|---|---|---|---|
| 10,316,467 | B2 * | 6/2019 | Weilach | D01F 2/00 |
| 11,142,589 | B2 * | 10/2021 | Turqueti | D21C 9/1057 |
| 2002/0155292 | A1 | 10/2002 | Sealey, II et al. | |
| 2015/0328561 | A1 | 11/2015 | Ginosau et al. | |
| 2021/0130501 | A1 * | 5/2021 | Silbermann | C08K 5/175 |

FOREIGN PATENT DOCUMENTS

| | | | |
|---|---|---|---|
| EP | 3339504 | A1 | 6/2018 |
| TR | 201111466 | | 2/2015 |
| TR | 2017/17752 | | 11/2017 |
| WO | 2017155487 | A1 | 9/2017 |
| WO | 2018104330 | A1 | 6/2018 |

* cited by examiner

FIBER PRODUCTION WITH SUPERCRITICAL FLUID PHASE FROM COTTON STRAW

TECHNICAL FIELD

The invention is related to obtaining regenerated cellulose fiber by using supercritical-$N_2O$ and/or supercritical-$CHF_3$ compounds from cotton straws which are turned into thin chips mechanically.

STATE OF THE ART

Today, it is thought that the petrochemical industry as one of the leading industry branches will encounter raw material shortness after the second half of this century. Besides that, due to reasons such as petroleum and petroleum products prices increase continuously with global crisis and they cause environmental pollution, cellulose and their derivatives obtained from lignocellulosic based substances are thought to gain their importance again as a substitute to petroleum based products. Many of the synthetic raw materials cause serious waste material problems because they do not dissolve in nature and they release toxic substances when they are burnt. As for cellulose raw material, it is a substance which is provided annually from nature and can be recycled after being used without giving harm to the environment.

The potential of agricultural wastes obtained from annual plants harvested each year in our country is approximately 37 million tons. It is considered as a requirement for the national economy to investigate the usage of this potential in forestry products industry. The agricultural waste obtained in our country is approximately 36.940.000 tons each year, the agricultural products consists of the wheat stem, barley stem, cotton straw, corn stem, sunflower stem, rice stem, rye stem, tobacco stem and lake reed (1). The estimated amounts of plant stems obtained in one year in Turkey are shown in Table 1.

TABLE 1

Estimated amounts of plant stems obtained in one year in Turkey

| Annual Plant | Annual Plant Stem Potential (Million Tons/Year) |
|---|---|
| Wheat stem | 18 |
| Barley Stem | 8 |
| Cotton straw | 3.5 |
| Sunflower stem | 3 |
| Corn stem | 2.5 |
| Hemp-cannabis | 2 |
| Tobacco stem | 0.3 |
| Rye stem | 0.24 |

TABLE 1-continued

Estimated amounts of plant stems obtained in one year in Turkey

| Annual Plant | Annual Plant Stem Potential (Million Tons/Year) |
|---|---|
| Rice stem | 0.2 |
| Lake reed | 0.2 |

Annual plants evaluated in particleboard industry for many years are materials that have low density compared to the normal firewood. Therefore in composite board manufacturing, during board pressing, due to selecting the compression factor high, using raw material with low density affects the resistance features of the board in a positive manner. Some technical features are determined after taking samples according to relevant standards two for each from the manufactured boards from each group. In conclusion conformity of the obtained composite boards to standards are investigated and it is determined that it can be used for general purposes.

| | | | | | Solubility (%) | | | |
|---|---|---|---|---|---|---|---|---|
| Raw material | Holo-cellulose (%) | Alfa-cellulose (%) | Lignin (%) | Ash (%) | Alcohol-Benzene (2/1) | 1 % NaOH | Hot water | Cold water |
| Peanut shell | 68.8 | 42.5 | 28 | — | 7 | 33.5 | 11.75 | 17 |
| Nut slag | 55.1 | 34.5 | 35.1 | 8.22 | 1.63 | 50.4 | 20.9 | 18.2 |
| Corn stem | 67.5 | 44.5 | 20.2 | 8.1 | 13.0 | 44.7 | 18.1 | 17.4 |
| Cotton straw | 71.6 | 31.2 | 20.5 | 5.54 | 6.63 | 48.6 | 12.2 | 8.39 |
| Leafed tree | 70-78 | 38-50 | 30-35 | 0.35 | 2-6 | 14-20 | 2-7 | 4-6 |
| Coniferous tree | 63-70 | 29-47 | 25-35 | 0.35 | 2-8 | 9-16 | 3-6 | 2-3 |

In Turkey, in a range from technologies used in the evaluation of the agricultural wastes, accepted as conventional to the advanced technologies, there is a serious gap in terms of manufacturing these technologies even practice of these technologies. Therefore developing and applying any technology related to the manufacturing of bio products are seen as supportable. In case the storage and handling of some annual plant wastes from the non-wood resources can be eliminated, it is considered that it would contribute to the economy by using it in composite board manufacturing.

The celluloses which are isolated from the wood and or have more or less purity are used as a raw material in the manufacture of the cellulose derivatives. In order to obtain many final products to be manufactured from the cellulose derivatives, some specifications searched in the product (purity level of the cellulose and structure thereof etc.) are available. The polymers are chain formed molecules consist of repeated monomers and the molecules are together by means of a number of attraction forces. The cellulose molecules are formed by joining the anhydroglucose units having (C6H10O5)n formula end to end. The number of these units is called degree of polymerization (DP) and they are bonded to each other with 1, 4-β-glucosidical bonds, one of each two units bonded with a 180 degree rotation to the other. As a result of this, a tension-free linear structure occurs.

There are many usage areas of cellulose except basic usage areas such as the paper and cardboard due to its being a polymeric product. Cellulose molecule (1) is a linear and natural polymer; it carries three hydroxyl groups that are sensitive against oxidation on each of the monomer unit.

This has the characteristic of bonding OH groups to the OH group of another cellulose chain. These bonds named as hydrogen bonds provide the cellulose molecules gain hydrophilic (hydrophile) characteristic.

The skeleton of trees consists of lignin, cellulose and hemicelluloses. The cellulose consists of the glucose units aligned in a chain pattern. These are primarily aligned in chain bundles side by side and then they create cell layers.

(1)

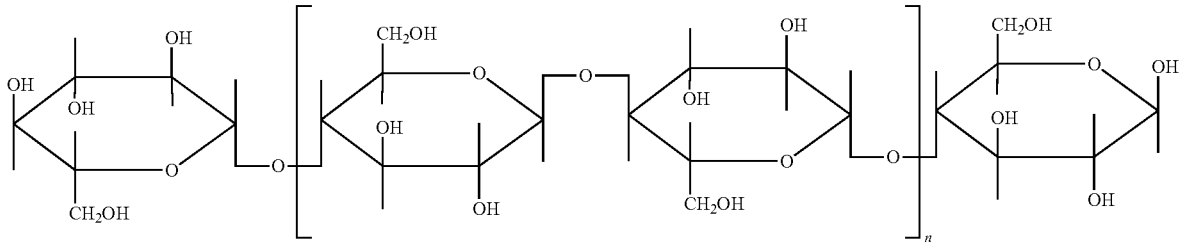

The products formed as a result of the chemical changes that the cellulose goes through are called as the cellulose derivatives. When the cellulose are transformed into its derivatives, hydroxyl groups react and therefore it not only forms inorganic and organic acids and their esters, some alcohols and their esters, bases and their aliquots and oxidation products with acids but also reacts with halides, amines and some complexes. The most important derivatives of the cellulose as an industrial product are cellulose esters and ethers. Before the cellulose esters and ethers occurred, creating alkali cellulose, it is a beginning process to be applied. Oxidative reactions of the cellulose and the derivatives given with the halides are the undesired reactions that occur during bleaching of the paper pulp.

Generally pre-hydrolyzed craft and solvable pulps with high alpha-cellulose ratio, obtained by acid sulfide method are used for the production of viscous rayon, cellulose esters (acetates, propionates, butyrates, nitrates) and cellulose ethers (carboxymethyl, ethyl, methyl). The aim of creating derivatives is to provide the cellulose compound to dissolve in general solutions because the cellulose does not dissolve in ordinary solutions. Therefore, this solubility allows for creating fiber, film and plastics from an appropriate technology. During preparation of the cellulose derivatives, the substitute groups within the cellulose molecule come to light and this process causes changes in physical properties. Thus this determines usefulness of the cellulose derivatives in terms of industry. This effect arises out of both natural substitute groups and the substitution degree. The mechanical and physical features of both cellulose and cellulose derivatives vary according to the average molecular weights. Any increase in the molecular weight creates an effect in the direction of resistance values. However the degree of this effect decreases after a determined level.

On the other hand the cellulose xanthate is an important intermediate in the production of regenerated cellulose; it is very difficult to classify this reaction. The dithiocarbonic acid (xanthagonic acid) actually exhibits a salt character more than an ester. In the preparation processes of viscous rayon and cellulosic film, cellulose xanthate is a very important cellulose derivative with its occurrence. In the first step of the process, cellulose is treated with 18% NaOH and obtained alkali cellulose is proceed with CS2 and as a result of the reaction cellulose xanthate is obtained.

The cell and wall of the plants consists of three main elements, said elements are lignin, cellulose and hemicelluloses. Actually, the structure that creates the skeleton in plants is this structure which is aligned in a matrix pattern. Semi celluloses are aligned together with the cellulose near them in a shapeless manner. On the other hand lignin is both shapeless and covers celluloses and hemicelluloses. General view of the wood cell is given in FIG. 1.

The wood cells (H) bond to lignin in the middle layer (ML) region which is rich in lignin. The lignin here is approximately 25-30% of the total lignin. The primary cell wall (P) consists of the cellulose based micro filaments which are aligned randomly. Both lignin and cellulose are named as the middle layer. Secondary cell wall consists of 3 layers such as the lower, intermediate and upper layers. The lower (S1) and upper layers (S3) are thin; the intermediate layer (S2) is the actual main layer. Their thickness varies according to the cell type and season. A rough (W) layer is available at the innermost section in some cells.

Since the intermediate layer (S2) is thick, the alignment of the micro filaments that it has is important for the cellulose. This crosswise alignment is important in terms of the mechanical and physical strength of the fiber and this direction in the cellulose is named as the micro filament angle.

Cellulose exists much more in the second section of the cell wall (intermediate layer). At this section cellulose chain rings create the chain by being aligned side by side, the chains are aligned in layers by bonding each other side by side. Then the layers are aligned as one on the top of the other in layers. Two different structures are seen due to the glucose inside in alignment in layers. These structures are named as alpha cellulose and beta cellulose. The axes of the crystals in the alpha cellulose (A) layers are aligned on the same line, however it is aligned diverted in the beta cellulose (B). The arrangements of alpha cellulose and beta cellulose are shown schematically in FIG. 2.

Although both of the alignments can be seen in the cellulose, also it is named as the alignment of cellulose crystals. On one hand alpha alignment is a semi decided alignment, on the other hand beta alignment is in a more decided structure. All alpha alignments can transform into beta alignment under high pressure and temperature, within an acidic or alkali environment.

The lignin inside the wood is removed in 95% during the extraction processes of cellulose, hemicellulose polymers. During bleaching, the degree of whiteness increases in connection with the other colored pigments and the removal of lignin amount from the wood pulp. The process of bleaching the mashed pulp with chemical materials as chlorine, alkali, hypochlorite and chlorine dioxide is followed by fragmenting lignin with oxygen in 1970's and added to the process after baking with the chemical materials and before bleaching. The main aim in the bleaching processes is to develop processes that decrease bleaching costs and minimize environmental effects.

Lignin fragmentation reaction implemented in the present state of the art is as follows;

In grinding containers with 20-30 meter height, chips are baked at 170 C° during 30 minutes, The temperature is fixed to 140-180 C° under 10 atm pressure after the baking process, The lower temperature of the grinding container is fixed to 65 C°, At the last step the following reactions happen.

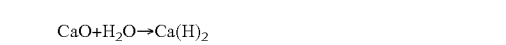

$$R—R'+NaOH \rightarrow R''COONa+ROH \text{ (Lignin: R—R')}$$

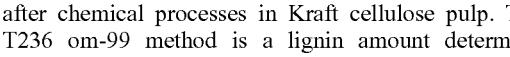

$$R—R'+Na_2S \rightarrow \text{Mercaptans}:H_2S;\ NaSH,\ Na_2S$$

a. Chemical Recovery

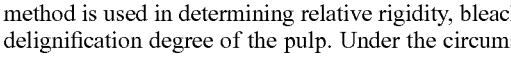

$$2NaR+O_2 \rightarrow Na_2CO_3+CO_2 \text{ (Lignin: NaR)}$$

b. Causticizing

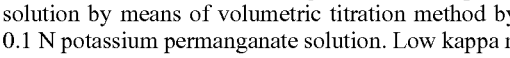

$$Na_2CO_3\ (aq)+Ca(OH)_2\ (s) \rightarrow 2NaOH\ (aq)+CaCO_3\ (s)$$

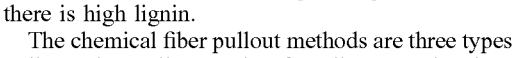

$$CaCO_3 \rightarrow CaO+CO_2$$

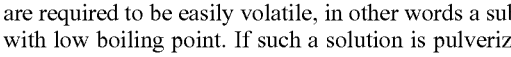

$$CaO+H_2O \rightarrow Ca(H)_2 \quad (2)$$

Kappa number is grading the lignin amount which is left after chemical processes in Kraft cellulose pulp. TAPPI-T236 om-99 method is a lignin amount determination method used in the determination of kappa number. This method is used in determining relative rigidity, bleaching or delignification degree of the pulp. Under the circumstances stated in the method, kappa number of the pulp without moisture is calculated according to the consumption of the solution by means of volumetric titration method by using 0.1 N potassium permanganate solution. Low kappa number shows that cellulose has low lignin; high number shows that there is high lignin.

The chemical fiber pullout methods are three types as wet pullout, dry pullout and soft pullout. In the dry pullout method, solvents to be used for preparing polymer solution are required to be easily volatile, in other words a substance with low boiling point. If such a solution is pulverized into rooms from the nozzles under fixed pressure and where hot air flow is passed, the solution easily evaporates and a polymer material formed as a filament is left. Acetate, triacetate, acrylic fibers are obtained by means of the dry pullout method.

In soft pullout method, polymers having thermoplastic (thermoformed) feature which are not dissolved in any solvent, are made filaments by means of the soft pullout method. In this method; polymer substances in chips form is made liquid (melt) at temperatures higher than the melting point. Melted polymer are pulverized from nozzle heads into the rooms where cold air flow is passed, melted polymer becomes solid as a filament in the cold rooms. Polyamide, polyester and polyurethane are obtained by means of the soft pullout method.

Viscose fiber is obtained generally in two forms such as in filament form (viscose rayon) and in staple form (viscose). The cellulose raw material obtained from the wood and linter for viscose production is purified from foreign matters by being treated with caustic soda and sodium bisulphite. The cellulose pulp is transformed into alkali cellulose after being treated by caustic soda solution (NaOH) and the cellulose xanthenate is obtained by adding carbon sulfur (CS2) to the alkali cellulose after pre-maturation process. It is transformed into a raw viscose solution with the addition of diluted sodium hydroxide. After filtering and post-maturation process, viscose solution is pulverized from the nozzles into a bath with acid, solid firm viscose filaments are obtained by wet pullout method, the filament obtained from the nozzle head with one hole is called "monofilament" and the filament obtained from the nozzle head with a plurality of holes is called "multifilament". Viscose rayon thread is obtained by winding the solidified filaments to the bobbin after the stretching, washing and drying processes.

Another method applied in the state of the art is Lyocell method. Lyocell method is to dissolve the hot solute lignin under water vapor and intensive cut simultaneously. This production method is very clean, very viscous solution is extruded in the diluted solution. This solute is recovered by separating from spinning and washing. Effective solute recovery is a key criterion for decreasing the costs and obtaining a successful process, fibers can be produced as a filament and staple that has circular section.

In Lyocell method when N-methyl morpholine-N-oxide is used, due to second reactions come, polymer chain lengths are different and due to occurrence of keto compounds in polymer side groups, the strength of the fiber decreases and hairiness increases.

In viscous method, in the step of bringing the polymer degree of the cellulose molecules within the viscose solution appropriate to the viscose pullout, its retention time within NaOH solution is more than 6 hours. This is a very long period and it extends the duration of the process.

When the fiber lengths of the plants, fiber micronaire, lignin amounts, and cellulose amounts determined as a result of the studies made in the present state of the art are compared; it shows that cotton straw can be used as a different cellulose raw material source due to its different fiber length, fiber micronaire, lignin content and α cellulose amounts. In a study made, it is determined that the cotton straw comprises 43.8% a cellulose and 15.4% lignin [1].

The chemical compounds that some plant stems include are determined again in a study made and the obtained data is given in Table 3 [2].

TABLE 3

The chemical compounds that some plant stems include

| Compound (%) | Corn Plant Stem | Canola Plant Stem | Palm Tree Leaf Stem | Cotton Plant Stem |
|---|---|---|---|---|
| Ash content | 24.9 | 6.6 | 9 | 2.2 |
| Cellulose | 39 | 36.6 | 45 | 58.5 |
| Holo-cellulose | 82.1 | 73.6 | 74.8 | 72.9 |
| Hemi-cellulose | 42 | 42 | 29.8 | 14.4 |
| Lignin | 7.3 | 17.3 | 27.2 | 21.4 |
| Moisture content | 7.3 | 0 | 5 | 17.5 |

In another study made in the present state of the art, the chemical analysis of the cotton straw and different plants that are grown in the same year and the trees are compared with each other. Again in the same study, the fiber features of the cotton straw are determined and it is compared with other fibers that are used for the production of paper. The data obtained as a result of said studies are given in Table 4 and Table 5.

TABLE 4

The chemical analysis results of the cotton straw and different plants that are grown in the same year and the trees

| Raw material | Holo-cellulose (%) | Cellulose (%) | Alpha cellulose (%) | Lignin (%) | Ash (%) | Silica (%) | In cold water (%) | In hot water (%) |
|---|---|---|---|---|---|---|---|---|
| Cotton straw | 75.6 | 45.5 | 39.8 | 18.2 | 2.52 | 0.48 | 11.7 | 15.3 |
| Wheat stem | 77 | 52.1 | 39.8 | 18.1 | 7.04 | 5.43 | 7.7 | 12.4 |
| Rice stem | 70.9 | 48.2 | 35.6 | 17.2 | 16.6 | 14.9 | 10.7 | 16.2 |
| Rye stem | 74.1 | 51.5 | 44.4 | 15.4 | 3.2 | 1.5 | 10.2 | 13 |
| Kenaf stem | 77.9 | 54.4 | 37.4 | 14.5 | 4.1 | — | 12.8 | 11.7 |
| Bamboo | 70.5 | 53.4 | 43.3 | 24.5 | 1.4 | — | — | 6.5 |

| Raw material | Fiber length (mm) | Fiber width (micrometer) | Lumen (micrometer) | Cell wall thickness (Micrometer) |
|---|---|---|---|---|
| Cotton straw | 0.81 | 24.98 | 16.75 | 4.12 |
| Wheat stem | 0.74 | 13.2 | 4.02 | 4.59 |
| Rice stem | 0.89 | 14.8 | 6.4 | 4.2 |
| Canola stem | 1.17 | 23.02 | 12.5 | 5.26 |
| Pine tree | 3-7 | 32-48 | 15-30 | 13-17 |

After lignin and hemi cellulose polymer structures included within the structure of the cotton straw are separated, the pre-maturing or aging process named as pre-aging curve in the conventional methods lasts 250 minutes in NaOH solution. Therefore the duration and cost of the process is high.

Concerning the utilization of the annual plant stems in the present state of the art, we found out the patent application No TR 2011 11466. The invention is related to a surface covering material that is developed for making a significant contribution to sound and heat insulation, it consists of grinded fiber source or annual plant stem, bonding resin and preferably pigment substances. After being mixed with water, obtained surface covering material is waited fifteen to twenty minutes and applied to any kind of surfaces by means of a plastic trowel.

In Chinese patent application No CN101298701A, cotton thread production method from a cotton straw skin fiber is disclosed. However said application does not comprise baking and bleaching process steps and appropriate viscous solution for fiber pullout is not prepared. The applied and unapplied process steps change the features of the obtained fibers.

Another application is the patent application No TR 2017 17752 titled as 'Fiber and nonwoven fabric production from the rice stems'. The invention is related to a new method in utilizing the agricultural wastes, a new textile raw material to be used in the textile sector in botanical fibers class and production of nonwoven fabric. This invention embodies a production process that consists of pre basic process application to the rice stems, subsequent processes, dredging and pinning steps. The configuration subject to the invention comprises a pre-process implementation under standard atmospheric conditions (room temperature) with a 1:20 flotte ratio it is hold during 10 days in a 20% NaOH (Sodium Hydroxide), 2% Pectinase enzyme (Bioprep 3000 L Alfa Chemical), 2% nonionic wetting agent. Then in order to terminate and soften the activation of the enzyme, detergent+softener wash during 30 minutes at 40° C. is made. A dredge belt is produces by being dredged with the 10/1 ratio cotton (10: rice stem fiber, 1: 100% cotton) in the dredger. The dredge belt comprises obtaining nonwoven fabric after completing pinning process.

Consequently due to the abovementioned disadvantages and deficiencies, a development is required to be made in the relevant technical field.

Aim of the Invention

The present invention is related to the production of fiber with super critical fluid phase from the cotton straw, which fulfills the abovementioned requirements, eliminates all disadvantages and brings some additional advantages.

The main aim of the invention is to obtain less or more pure regenerated cellulose fiber by using the process of supercritical fluid phase from cotton straw.

The aim of the invention is to obtain cellulose fiber-cellulose filament from the cotton straw used a different cellulose raw material source.

The aim of the invention is to obtain cellulose fiber by separating alpha cellulose by removing lignin from the cotton straw which is used as a cellulose raw material source.

The aim of the invention is to utilize from ne sources based on sustainable and renewable lignocellulose.

In order to fulfill the abovementioned aims, the invention is a method for obtaining a regenerated cellulose fiber, and it comprises the following process steps;

a) Treating cotton straw which is formed as a thin chip with diluted acetic acid, b) Obtaining cellulose pulp by separating hemi-cellulose part from the cotton straw treated with the diluted acetic acid solution, c) Subjecting the cellulose pulp to a bleaching process in order to remove lignin from its structure, d) Obtaining cellulose xanthate from cellulose macro molecules with intrinsic viscosity value, e) Processing cellulose solution in neutralization bath and pulling out the fiber from the nozzles, characterized in that it comprises the following process steps;

Allowing cellulose macro molecules to have intrinsic viscosity values by using super critical —$N_2O$ and/or super critical-$CHF_3$ solution during c and d process steps.

The structural and characteristic features of the present invention will be understood clearly by the detailed description made and therefore the evaluation shall be made by taking the detailed description into consideration.

FIGURES CLARIFYING THE INVENTION

FIG. 1: It is a general view of the wood cell.

Figure 2:
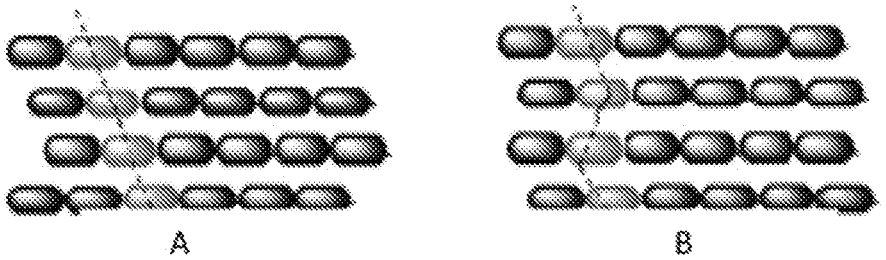

FIG. 2: It is a schematic view of alpha cellulose and beta cellulose alignments.

The drawings shall not be scaled necessarily and the details that are not required for understanding the present invention can be omitted. Apart from this, elements that are at least substantially identical or at least having substantially similar functions are shown with the same numeral.

DESCRIPTION OF PART REFERENCES

A. Alfa cellulose
B. Beta cellulose
H. Wood cell
ML. Middle layer
S1. Lower layer
S2. Intermediate layer
S3. Upper layer
P. Primary cell wall
W. Rough layer

COMPOUND REFERENCE NUMBERS CLARIFYING THE INVENTION (1) Cellulose molecule
(2) Lignin fragmentation reaction
(3) Reaction of the cellulose molecule with super critical fluid $N_2O$
(4) Reaction of the cellulose molecule with super critical fluid $CHF_3$

DETAILED DESCRIPTION OF THE INVENTION

In this detailed description, the method for obtaining fiber with supercritical fluid phase from the cotton straw which is formed mechanically as a thin chip, is described only in order to clarify the subject matter and in a manner without creating any limiting effect.

$N_2O$ supercritical (SC) fluid to be used in order to obtain fiber from the cotton straw is created at 313-353° K. temperatures and 7.00-24.5 MPa pressure values with 2.3-10% by weight. The transition value of Dinitrogen monoxide ($N_2O$) optimum supercritical value is 71 bar (7.1 Mpa) and 36.5° C. Within this environment cellulose/$N_2O$/$H_2O$ is available. Within cellulose macro molecules included within this fluid is SC $N_2O$—H bonds instead of H—O. When pressure and temperature is changed, because $N_2O$ does not make ionic or covalent bond with the cellulose macro molecule, it again passes to the gas phase and can be used again.

In the supercritical phase process, $N_2O$ and/or $CHF_3$ compounds are in a fluid phase at the determined pressure and temperature, they are not in solid or gas phase. The diffusion of the compounds into the cellulose solution in supercritical phase is accelerated, penetration between the cellulose macro molecules is increased and it creates hydrogen bridge bonds with macro molecules as a solvent. In this step, on one hand partially negative charged oxygen atom in $N_2O$ and the hydrogen atom in the hydroxyl group of $6^{th}$ carbon in the cellulose molecule that has partial positive charge creates bridge bond, on the other hand partially negative charged fluor atom in $CHF_3$ and the hydrogen atom in the hydroxyl group of $6^{th}$ carbon in the cellulose molecule creates bridge bond. In this step there are hydrogen bridge bonds based on the negative charge value of the oxygen atom in OH in other words hydroxyl within the cellulose macro molecule itself and between macro molecules. The oxygen in $N_2O$ with high negative value or fluor atom in $CHF_3$ creates bridge bonds with the hydrogen atoms in the hydroxyl group by entering into the cellulose macro molecules and in this manner macro molecular bonds by means of decreasing reach to the intrinsic viscosity value. By means of the supercritical phase process, similar to the conventional NaOH reactions used in the prior art, before bond ruptures occur in the cellulose chain, polymer chain length remains the same and intrinsic viscosity value is reached.

(3)

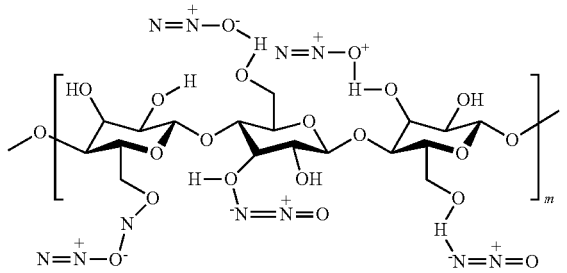

$N_2O$ (Nitrous Oxide) + [β-(1,4) Glucose], (Cellulose)

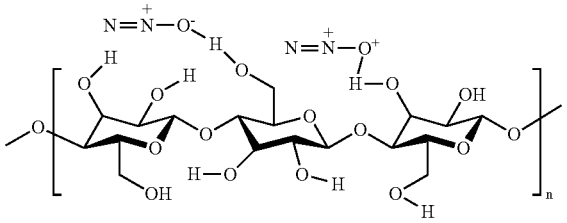

Nitroxide-Hydroxy Glucose)n (3)

At the end of the process, $N_2O$ or $CHF_3$, are passed to the gas phase again and recovered by changing supercritical pressure and temperature values.

Supercritical—$CHF_3$ fluid at Pc 48.0 atm and at 261° C. has dipole moment (db) of 1.6. The fluor (δ−) atom is more electronegative than the oxygen (δ−) atom. Therefore the hydrogen atoms between the cellulose macro molecules and for molecules prefer to bond to the fluor atom. The bond electrons are pulled out by the atom with high electronegativity. Therefore a polarization occurs. The hydrogen that is left without electron and partially positive charged interacts with the neighbor atom with high electronegativity in an electrostatic manner, it becomes a kind of bridge atom, here this hydrogen makes hydrogen bond with the fluor atom.

$CHF_3$ structure is a polar structure. Therefore the bond formation energy of $CHF_3$ is lower than the bond formation energy of OH groups in the cellulose molecule with the hydrogen atom between molecules it is easier to form H δ+—F δ-bond. H δ+—F δ−

(4)

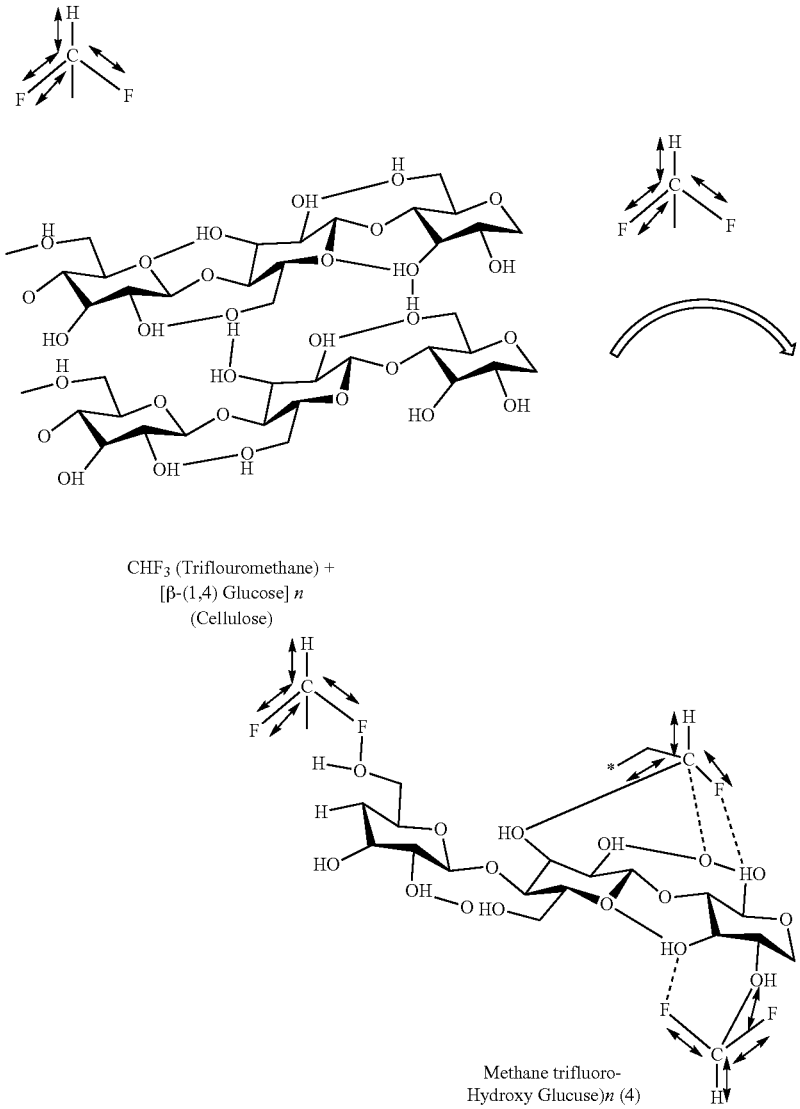

Due to the reason that $CHF_3$ is polar and its dipole moment is 1.6; the hydrogen (δ+) atom within the hydroxyl groups bonded to the $6^{th}$ carbon atom between the cellulose macro molecules and Fluor (δ−) atom make hydrogen bond. In order to realize this reaction, due to the supercritical (SC) fluid phase is Pc 48.0 atm and 26.1° C., the penetration and diffusion of $CHF_3$ between the cellulose macro molecules will be very easy. Within this environment there is cellulose/$CHF_3$/H2O and when the normal atmospheric pressure is available, $CHF_3$ is recovered.

Due to $CHF_3$ tetrahedral, $N_2O$ have linear geometric structure, their penetration between cellulose macro molecules occur more easily. N-methyl morpholine-N-oxide is 117 akb, $CHF_3$ 67 akb, $N_2O$ 44 akb. For this reason the diffusion speed of $CHF_3$ and $N_2O$ is faster than N-methyl morpholine-N-oxide. They enter more easily and more rapidly between the cellulose macro molecules, they make the macro molecules closer and increase the crystallization degree of the polymer. At the same time the values of dry and wet elongation ratios (%) are increased by dry and wet tenacity values (cN/dtex) among mechanical features of the fiber to be obtained by increasing the polymer degree of the solution.

The Method for Obtaining Fiber with the Supercritical Fluid Phase:

The cotton straw is transformed into thin chips mechanically,

The cotton straw chip is waited during 30 minutes 170° C. in a diluted acetic acid solution in autoclave (Acetic acid reaches from 90° C. to 170° C. in 2.67° C./minute), After the cotton straw chip is treated with diluted acetic acid solution, it is treated with sodium sulfide ($NaS_2$) and sodium hydroxide (NaOH) at 165° C. during 120 minutes and its hemi-cellulose section is separated and 92.7% cellulose pulp is obtained (Kappa number of the obtained pulp is 11.4, its whiteness degree is approximately 45%), In order to remove lignin within the cellulose pulp structure, first it is treated under 5 bar pressure and 100° C. with NaOH and MgSO4, then treated at 65° C. during 60 minutes treated with $ClO_2$, then treated at 75° C.

during 90 minutes with NaOH and $H_2O_2$, at the last phase treated at 80° C. with $ClO_2$ during 180 minutes and 120 minutes, subjected to bleaching process (after the bleaching process Kappa number is 1, whiteness degree reaches to 89%), The cellulose macro molecules are reached to intrinsic values by using supercritical-$N_2O$ and/or supercritical-$CHF_3$ solution, The cellulose macro molecules in intrinsic viscosity value is waited at 50° C. during 220 minutes in 18% NaOH and subsequently it is treated at 32° C. with 36% $CS_2$ solution and the cellulose xanthate occurs, The cellulose xanthate solution is subjected to neutralization (coagulation) bath at 40-60° C. that includes 6-10% by weight $H_2SO_4$, 10-30% by weight $NaSO_4$ and 1-4% by weight $ZnSO_4$ mixture and the fiber is pulled out from the nozzles with 40-80 mt/dk pullout velocity.

The viscosity of the regenerated cellulose fiber obtained by means of the abovementioned method is 450-550 ml/g, its brightness is (ISO) 88-92%, its kappa number is <0.5.

On one hand R18 value shows the ratio of the cellulose which is dissolved in the cellulose pulp within 18% NaOH aqueous solvent; on the other hand R10 values shows the cellulose ration which is dissolved in the cellulose pulp within 10% NaOH aqueous solvent. In the regenerated cellulose fiber obtained by means of the abovementioned method, R18 value is >95%, R10 value is >92%.

The number of xanthate group created by each 100 molecules of glucose monomers that forms the cellulose macro molecule with $CS_2$ gives gamma number. The gamma number of the regenerated cellulose fiber which is obtained by means of the method of the present invention is between 30-45.

Supercritical phase process is used instead of the process named as aging process in the conventional processes used in the present state of the art and waiting process of the cellulose solution whose lignin is removed with NaOH during 240-300 minutes. Therefore instinctive viscosity which is appropriate to viscose pullout is caught.

REFERENCES

1—C. Ververis, K. Georghiou, N. Christodoulakis, P. Santas, R. Santas, Fiber dimensions, lignin and cellulose content of various plant materials and their suitability for paper production, *Industrial Crops and Products*, Volume 19, Issue 3, May 2004, Pages 245-254, 2—Zawawi Daud, Mohd Zainuri Mohd Hatta, Angzzas Sari Mohd Kassim, Halizah Awang, Ashuvila Mohd Aripin, Analysis the chemical composition and fiber morphology structure of corn stalk, *Australian Journal of Basic and Applied Sciences* 7(9):401-405, 3—Ahmet Tutus, Ahmet Cenk Ezici and Saim Ates, Chemical, morphological and anatomical properties and evaluation of cotton stalks (Gossypium hirsutum I.) in pulp industry, *Scientific Research and Essays*, Vol. 5(12), pp. 1553-1560, June 2010

The invention claimed is:

1. A method for obtaining regenerated cellulose fiber, the method comprising:

treating cotton straw with acetic acid;

obtaining cellulose pulp by separating hemi-cellulose from the treated cotton straw;

removing lignin from the cellulose pulp by bleaching the cellulose pulp;

using supercritical $N_2O$ and/or supercritical $CHF_3$, after the step of removing lignin for diffusing respectively $N_2O$ and/or $CHF_3$ between macro molecules of the cellulose pulp;

obtaining and neutralizing cellulose xanthate from the macro molecules of the cellulose pulp in a coagulation bath; and pulling out the regenerated cellulose fiber from the coagulation bath.

2. The method of claim 1, wherein the coagulation bath comprises 6-10% by weight of $H_2SO_4$, 10-30% by weight of $NaSO_4$ and 1-4% by weight of a $ZnSO_4$ mixture.

3. The method of claim 1, wherein the coagulation bath has a temperature of 40° C. to 60° C.

4. The method of claim 1, wherein the step of pulling out is at 40-80 meters/minutes.

5. The method of claim 1, wherein a supercritical $N_2O$ solution used in the step of using, the method further comprising:

creating the supercritical $N_2O$ solution at a temperature of 313-353° K and at a pressure of 7-24.5 MPa, the supercritical $N_2O$ solution having $N_2O$ at 2.3-10% by weight.

6. The method of claim 1, wherein a supercritical $CHF_3$, solution is used in the step of using, the method further comprising:

creating the supercritical $CHF_3$, solution at a temperature of 26.1° C. and at a pressure of 48 atm and with a 1.6 dipole moment.

* * * * *